US010133199B2

(12) United States Patent
Hong

(10) Patent No.: US 10,133,199 B2
(45) Date of Patent: Nov. 20, 2018

(54) TONER FOR DEVELOPING ELECTROSTATIC IMAGE AND METHOD OF MANUFACTURING THE SAME

(75) Inventor: Jin-mo Hong, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 13 days.

(21) Appl. No.: 13/551,827

(22) Filed: Jul. 18, 2012

(65) Prior Publication Data

US 2013/0059246 A1 Mar. 7, 2013

(30) Foreign Application Priority Data

Sep. 5, 2011 (KR) ..... 10-2011-0089646

(51) Int. Cl.
*G03G 9/08* (2006.01)
*G03G 9/087* (2006.01)
*G03G 9/093* (2006.01)

(52) U.S. Cl.
CPC ..... *G03G 9/0821* (2013.01); *G03G 9/0825* (2013.01); *G03G 9/08755* (2013.01); *G03G 9/08795* (2013.01); *G03G 9/08797* (2013.01); *G03G 9/09328* (2013.01); *G03G 9/09371* (2013.01)

(58) Field of Classification Search
CPC ..... G03G 9/0821; G03G 9/0823; G03G 9/08755; G03G 9/08782; G03G 9/09; G03G 9/09328; G03G 9/08795; G03G 9/0825; G03G 9/08797; G03G 9/09371
USPC ..... 430/109.4, 110.2, 109.3, 108.1, 108.8
See application file for complete search history.

(56) References Cited

U.S. PATENT DOCUMENTS 6,200,719 B1 * 3/2001 Kuroda ..... G03G 9/0819 399/252
6,617,091 B2 9/2003 Nishimori et al.
7,972,758 B2 7/2011 Hamano
9,081,316 B2 7/2015 Hong et al.
2004/0110078 A1 * 6/2004 Teshima et al. ..... 430/110.2
2006/0216625 A1 * 9/2006 Maehata et al. ..... 430/109.3
2009/0148786 A1 * 6/2009 Ashley ..... G03G 9/0804 430/137.14
2009/0286176 A1 * 11/2009 Ohmura et al. ..... 430/107.1
2010/0173242 A1 * 7/2010 Joo et al. ..... 430/108.4
2010/0297546 A1 * 11/2010 Zhou ..... G03G 9/0819 430/108.23
2010/0330486 A1 * 12/2010 Zhou et al. ..... 430/108.4
2011/0104605 A1 * 5/2011 Kim ..... G03G 9/0819 430/108.4

FOREIGN PATENT DOCUMENTS

JP 2008-116613 5/2008
KR 10-2011-0070200 6/2011

OTHER PUBLICATIONS

Korean Notice of Allowance dated Aug. 30, 2017 in corresponding Korean Patent Application No. 10-2011-0089646.

* cited by examiner

*Primary Examiner* — Thorl Chea
(74) *Attorney, Agent, or Firm* — Staas & Halsey LLP

(57) ABSTRACT

A toner for developing an electrostatic image and a method of manufacturing the same are provided. The toner may have a morphological surface characteristic that induces high thermal and physical characteristics. The toner may simultaneously improve gloss, charge stability, anti-cohesiveness, storage ability, and low temperature fixability.

1 Claim, 1 Drawing Sheet

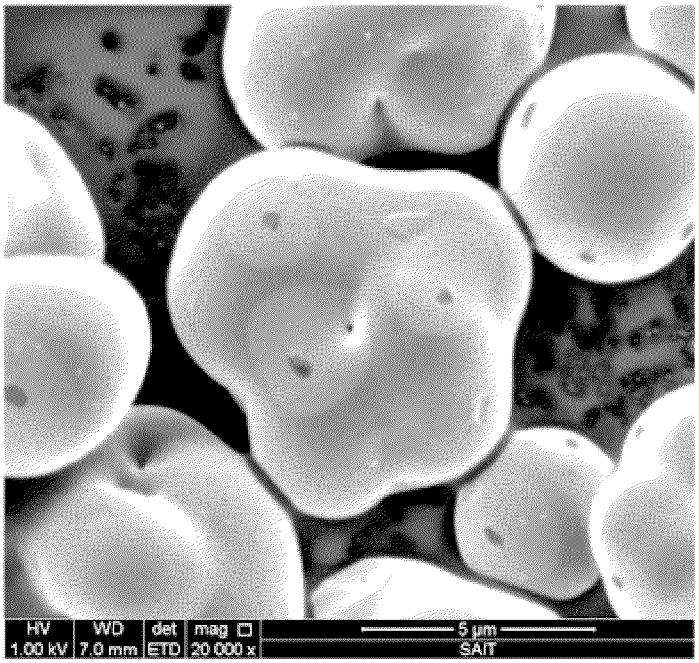
HV
1.00 kV
WD
7.0 mm
det
ETD
mag
20 000 x
5 µm
SAIT

TONER FOR DEVELOPING ELECTROSTATIC IMAGE AND METHOD OF MANUFACTURING THE SAME

CROSS-REFERENCE TO RELATED APPLICATION(S)

This application claims priority from and the benefit under 35 U.S.C. § 119 of Korean Patent Application No. 10-2011-0089646, filed on Sep. 5, 2011, in the Korean Intellectual Property Office, the disclosure of which is incorporated herein in its entirety by reference.

BACKGROUND

1. Field

The present general inventive concept relates to a toner for developing an electrostatic image and a method of manufacturing the toner.

2. Discussion of the Background

A toner for developing an electrostatic image is used in a printing device that prints according to an electrophotographic and electrostatic image developing process.

Small particle size, narrow particle size distribution, wide color gamut, and lower fixing temperature are considered as important quality properties of a toner. The small particle size, narrow particle size distribution, and wide color gamut provide for obtaining a high quality printing image. The lower fixing temperature provides for reducing energy consumption for printing and for reducing emission of carbon dioxide. Of course, other quality properties, such as high temperature preservation, anti-cohesiveness, and charge stability are also important.

As a method of manufacturing a toner, a pulverizing process has been proposed. In the pulverizing process, excessive energy is consumed for manufacturing a toner having a small particle size, and controlling the morphology of the toner particles is very difficult. Also, a releasing agent or a pigment may be exposed on a surface of the toner, and thus, anti-cohesiveness and storage ability are degraded.

As another method of manufacturing a toner, an emulsion and aggregation (EA) process has been proposed. In the EA method, toner particles are grown through agglomeration of various raw material particles. Accordingly, in the EA process, quality properties, such as small particle size and narrow particle size distribution may be easily obtained, and also, controlling the morphology of toner particles is relatively easy. ° C.A toner manufactured by the EA process is referred to as a "polymerized toner". In a conventional EA process, a styrene-acrylate copolymer is used as a binder resin. However, because a color toner is frequently used in various application fields, transparency and fixing temperature of the binder resin may be improved, Toner particles having a resin layer (shell) on a surface of a coloring particle (core particle) that include a resin and a colorant to provide a polymerized toner that has a small amount of the colorant present at the surface of the toner particle; and that does not cause variation in image density, fogging, and changing of color of a color image due to the change of charging properties and developing ability even after the toner is used to form a color image for a long period of time under a humid atmosphere has been proposed. This method may increase charge uniformity between colors to some degree by pressing surface exposure of a pigment. However, for example, when a large amount of wax is included in the toner, the heat storage ability and anti-cohesiveness at a high temperature may be reduced due to a plasticizing effect caused by some degree of partial miscibility between a low molecular weight portion of wax and a resin.

A method of encapsulating a surface of a binder resin having a low glass transition temperature Tg with a binder resin having a slightly higher Tg has been proposed for a low temperature fixing. This method may provide a low temperature fixing property, but may not sufficiently provide a high temperature storage ability and a gloss property.

SUMMARY

The present general inventive concept provides a toner for developing an electrostatic image. The toner may simultaneously improve gloss, charge stability, anti-cohesiveness, storage ability, and low temperature fixability Additional features and utilities of the present general inventive concept will be set forth in part in the description which follows and, in part, will be obvious from the description, or may be learned by practice of the general inventive concept.

The present general inventive concept also provides a method of manufacturing a toner having the above characteristics for developing an electrostatic image.

According to an exemplary embodiment of the present general inventive concept, there is provided a toner for developing an electrostatic image, the toner including a crystalline polyester resin, an amorphous polyester resin, a releasing agent, and a colorant, and wherein the toner satisfies the following Equations (1) and (2):

$$-4.3 \leq \log(S_{stain}/S_{toner}) \leq -2.1, \quad (1)$$

$$5 \leq N_{stain} \leq 25, \quad (2)$$

wherein $S_{toner}$ is a surface area of the toner particles, $S_{stain}$ is a total area of stained regions formed on the surfaces of the toner particles when the toner particles are stained with ruthenium tetroxide ($RuO_4$), and $N_{stain}$ is the number of the stained regions.

The crystalline polyester resin and the amorphous polyester resin may satisfy the following Equations (3) and (4):

$$1 \leq R_{crystalline}/R_{amorphous} \leq 100, \quad (3)$$

$$15 \leq \log [R_{crystalline}] \leq 20, \quad (4)$$

Here, $R_{crystalline}$ is an electrical resistance [Ω] of the crystalline polyester resin and $R_{amorphous}$ is an electrical resistance [Ω] of the amorphous polyester resin.

The crystalline polyester resin, the amorphous polyester resin, and the releasing agent may satisfy the following Equations (5), (6), and (7):

$$\Delta SP_{\alpha} = |SP_{amorphous} - SP_{crystalline}| \geq 3, \quad (5)$$

$$\Delta SP_{\beta} = |SP_{crystalline} - SP_{wax}| \leq 1, \quad 6)$$

$$\Delta SP_{\gamma} = |SP_{amorphous} - SP_{wax}| \geq 2.5, \quad (7)$$

Here, $SP_{amorphous}$ is the solubility parameter $[(J/cm^3)^{0.5}]$ of the amorphous polyester resin, $SP_{crystalline}$ is the solubility parameter $[(J/cm^3)^{0.5}]$ of the crystalline polyester resin, and $SP_{wax}$ is the solubility parameter $[(J/cm^3)^{0.5}]$ of the releasing agent.

The toner may include: a core layer that includes the crystalline polyester resin, the amorphous polyester resin, the releasing agent, and the colorant; and a shell layer that includes another amorphous polyester resin.

The crystalline polyester resin and the amorphous polyester resin of the core layer may satisfy the following Equations (3) and (4):

$$1 \leq R_{crystalline}/R_{amorphous} \leq 100, \quad (3)$$

$$15 \leq \log [R_{crystalline}] \leq 20, \quad (4)$$

wherein, $R_{crystalline}$ is an electrical resistance [Ω] of the crystalline polyester resin of the core layer and $R_{amorphous}$ is an electrical resistance [Ω] of the amorphous polyester resin of the core layer.

The crystalline polyester resin of the core layer, the amorphous polyester resin of the core layer, and the releasing agent of the core layer may satisfy the following Equations (5), (6), and (7):

$$\Delta SP_{\alpha} = |SP_{amorphous} - SP_{crystalline}| \geq 3, \quad (5)$$

$$\Delta SP_{\beta} = |SP_{crystalline} - SP_{wax}| \leq 1, \quad (6)$$

$$\Delta SP_{\gamma} = |SP_{amorphous} - SP_{wax}| \geq 2.5, \quad (7)$$

Here, $SP_{amorphous}$ is the solubility parameter $[(J/cm^3)^{0.5}]$ of the amorphous polyester resin of the core layer, $SP_{crystalline}$ is the solubility parameter $[(J/cm^3)^{0.5}]$ of the crystalline polyester resin of the core layer, and $SP_{wax}$ is the solubility parameter $[(J/cm^3)^{0.5}]$ of the releasing agent of the core layer.

According to an exemplary embodiment of the present general inventive concept, there is provided a method of manufacturing toner for developing an electrostatic image, the method including: forming a core by mixing a first binder resin latex that comprises a crystalline polyester resin and an amorphous polyester resin, a releasing agent, and a colorant with a coagulant; adding a second binder resin latex that comprises an amorphous polyester resin to a dispersed solution of the core so that a shell layer of the second binder resin latex is deposited on at least a portion of the core surface, thus forming a particle that comprises the core and the shell layer; coagulating the particles to form a coagulated particle; and unifying the coagulated particle to form a toner particle, wherein the crystalline polyester resin of the first binder resin, the amorphous polyester resin of the first binder resin, and the releasing agent satisfy the following Equations (5), (6), and (7):

$$\Delta SP_{\alpha} = |SP_{amorphous} - SP_{crystalline}| \geq 3, \quad (5)$$

$$\Delta SP_{\beta} = |SP_{crystalline} - SP_{wax}| \leq 1, \quad (6)$$

$$\Delta SP_{\gamma} = |SP_{amorphous} - SP_{wax}| \geq 2.5, \quad (7)$$

wherein $SP_{amorphous}$ is the solubility parameter $[(J/cm^3)^{0.5}]$ of the amorphous polyester resin of the first binder resin, $SP_{crystalline}$ is the solubility parameter $[(J/cm^3)^{0.5}]$ of the crystalline polyester resin of the first binder resin, and $SP_{wax}$ is the solubility parameter $[(J/cm^3)^{0.5}]$ of the releasing agent.

The second binder resin may include a low molecular weight amorphous polyester resin having a weight-average molecular weight in a range from 6,000 to 20,000 g/mol and a high molecular weight amorphous polyester resin having a weight-average molecular weight in a range from 25,000 to 100,000 g/mol.

The crystalline polyester resin of the first binder resin and the amorphous polyester resin of the first binder resin may satisfy the following Equations (3) and (4):

$$1 \leq R_{crystalline}/R_{amorphous} \leq 100, \quad (3)$$

$$15 \leq \log [R_{crystalline}] \leq 20, \quad (4)$$

Here, $R_{crystalline}$ is an electrical resistance [Ω] of the crystalline polyester resin of the first binder resin and $R_{amorphous}$ is an electrical resistance [Ω] of the amorphous polyester resin of the first binder resin.

According to an exemplary embodiment of the present general inventive concept, there is provided a toner for developing an electrostatic image, the toner includes: a crystalline polyester resin; an amorphous polyester resin; a releasing agent; and a colorant, wherein the crystalline polyester resin and the amorphous polyester resin satisfy the following Equations (3) and (4):

$$1 \leq R\text{crystalline}/R\text{amorphous} \leq 100, \quad (3)$$

$$15 \leq \log [R_{crystalline}] \leq 20, \quad (4)$$

wherein $R_{crystalline}$ is an electrical resistance [Ω] of the crystalline polyester resin and $R_{amorphous}$ is an electrical resistance [Ω] of the amorphous polyester resin.

According to an exemplary embodiment of the present general inventive concept, there is provided a toner for developing an electrostatic image, the toner includes: a crystalline polyester resin; an amorphous polyester resin; a releasing agent; and a colorant, wherein the crystalline polyester resin, the amorphous polyester resin, and the releasing agent satisfy the following Equations (5), (6), and (7):

$$\Delta SP_{\alpha} = |SP_{amorphous} - SP_{crystalline}| \geq 3, \quad (5)$$

$$\Delta SP_{\beta} = |SP_{crystalline} - SP_{wax}| \leq 1, \quad (6)$$

$$\Delta SP_{\gamma} = |SP_{amorphous} - SP_{wax}| \geq 2.5, \quad (7)$$

wherein $SP_{amorphous}$ is the solubility parameter $[(J/cm^3)^{0.5}]$ of the amorphous polyester resin, $SP_{crystalline}$ is the solubility parameter $[(J/cm^3)^{0.5}]$ of the crystalline polyester resin, and $SP_{wax}$ is the solubility parameter $[(J/cm^3)^{0.5}]$ of the releasing agent.

According to an exemplary embodiment of the present general inventive concept, there is provided a toner for developing an electrostatic image, the toner includes: a crystalline polyester resin; an amorphous polyester resin; a releasing agent; and a colorant, wherein the toner satisfies the following Equations (1) and (2):

$$-4.3 \leq \log(S_{stain}/S_{toner}) \leq -2.1, \quad (1)$$

$$5 \leq N_{stain} \leq 25, \quad (2)$$

wherein $S_{toner}$ is a surface area of the toner particles, $S_{stain}$ is a total area of stained regions formed on the surfaces of the toner particles when the toner particles are stained with ruthenium tetroxide ($RuO_4$), and $N_{stain}$ is the number of the stained regions, wherein the crystalline polyester resin and the amorphous polyester resin satisfy the following Equations (3) and (4):

$$1 \leq R_{crystalline}/R_{amorphous} \leq 100, \quad (3)$$

$$15 \leq \log [R_{crystalline}] \leq 20, \quad (4)$$

wherein $R_{crystalline}$ is an electrical resistance [Ω] of the crystalline polyester resin and $R_{amorphous}$ is an electrical resistance [Ω] of the amorphous polyester resin, and wherein the crystalline polyester resin, the amorphous polyester resin, and the releasing agent satisfy the following Equations (5), (6), and (7):

$$\Delta SP_{\alpha} = |SP_{amorphous} - SP_{crystalline}| \geq 3, \quad (5)$$

$$\Delta SP_{\beta} = |SP_{crystalline} - SP_{wax}| \leq 1, \quad (6)$$

$$\Delta SP_{\gamma} = |SP_{amorphous} - SP_{wax}| \geq 2.5, \quad (7)$$

wherein $SP_{amorphous}$ is the solubility parameter $[(J/cm^3)^{0.5}]$ of the amorphous polyester resin, $SP_{crystalline}$ is the solubility parameter $[(J/cm^3)^{0.5}]$ of the crystalline polyester resin, and $SP_{wax}$ is the solubility parameter $[(J/cm^3)^{0.5}]$ of the releasing agent.

According to the current general inventive concept, the toner may simultaneously satisfies gloss, charge stability, anti-cohesiveness, storage ability, and low temperature fixability greater than a certain level, and thus, a high degree image characteristic may be realized. Also, a toner having a long durability may be manufactured.

BRIEF DESCRIPTION OF THE DRAWINGS

These and/or other features and utilities of the present general inventive concept will become apparent and more readily appreciated from the following description of exemplary embodiments, taken in conjunction with the accompanying drawings of which:

FIG. 1 is a scanning electron microscopic (SEM) image of toner particles stained with ruthenium tetroxide ($RuO_4$).

DETAILED DESCRIPTION OF THE ILLUSTRATED EMBODIMENTS

Reference will now be made in detail to exemplary embodiments of the present general inventive concept, examples of which are illustrated in the accompanying drawings, wherein like reference numerals refer to the like elements throughout. Exemplary embodiments are described below in order to explain the present general inventive concept while referring to the figures. A toner for developing an electrostatic image, according to the present general inventive concept, will now be described in detail.

The toner includes a crystalline polyester resin, an amorphous polyester resin, a releasing agent, and a colorant, and satisfies the following Equations (1) and (2).

$$-4.3 \leq \log(S_{stain}/S_{toner}) \leq -2.1, \quad (1)$$

$$5 \leq N_{stain} \leq 25, \quad (2)$$

Here, $S_{toner}$ is a surface area of the toner particles, $S_{stain}$ is a total area of stained regions formed on the surfaces of the toner particles when the surfaces of the toner particles are stained with ruthenium tetroxide ($RuO_4$), and $N_{stain}$ is the number of the stained regions.

The crystalline polyester resin and the amorphous polyester resin may, individually or combined, be binder resins for fixing the releasing agent and the colorant.

The crystalline polyester resin denotes a polyester resin having a distinct endothermic peak in its differential scanning calorimetry (DSC) curve. For example, in the DSC method, when a temperature rising rate is set to 10° C./min, the crystalline polyester resin may be defined as having an endothermic peak in which a half-width value is within 15° C. The crystalline polyester resin may be used for further improving an image gloss property and a low temperature toner fixing property.

In the DSC method, the amorphous polyester resin denotes a polyester resin that does not have a clear endothermic peak. For example, in the DSC method, when a temperature rising rate is set to 10° C./min, the amorphous polyester resin may be defined as showing a stepwise change of endothermic calories or as having a half-value width of the endothermic peak that exceeds 15° C.

The polyester resin may be manufactured by causing a reaction of an aliphatic, alicyclic, or aromatic polycarboxylic acid or an alkyl ester thereof with a polyalcohol through a direct esterification reaction or a trans-esterification reaction.

The crystalline polyester resin may be obtained by causing a reaction between an aliphatic polycarboxylic acid having a carbon number of, for example, 8 or more (except for carbons included in carboxylic groups), as another example, from 8 to 12, and as still another example, from 9 to 10, with a polyalcohol having a carbon number of, for example, 8 or more, as another example, from 8 to 12, and as still another example, 10.

The crystalline polyester resin may be, for example, a polyester resin obtained by causing a reaction of 1,9-nonanediol with 1,10-decanedicarboxylic acid, or 1,9-nonanediol with 1,12-dodecanedicarboxylic acid. When the carbon numbers are controlled to be in the above ranges, the crystalline polyester resin may have a melting temperature suitable for the toner. Also, the aliphatic components increase the straightness of the resultant resin structure, and thus, its affinity to an amorphous polyester resin.

A polycarboxylic acid used for obtaining an amorphous polyester resin may be, for example, at least one selected from the group consisting of phthalic acid, isophthalic acid, terephthalic acid, tetrachlorophthalic acid, chlorophthalic acid, nitrophthalic acid, p-carboxyphenylacetic acid, p-phenylene-2-acetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid. Besides dicarboxylic acids, polycarboxylic acids, such as, for example, trimellitic acid, pyromellitic acid, naphthalene tricarboxylic acid, naphthalene tetracarboxylic acid, pyrene tricarboxylic acid, and pyrene tetracarboxylic acid, may also be used. Also, carboxylic acid-based compounds in which the carboxylic group thereof is induced to form anhydride, oxychloride, or ester may be used. A lower ester denotes an ester of aliphatic alcohols having a carbon number of 1 to 8.

Specific examples of polyalcohol used for obtaining amorphous polyester resin is at least one selected from the group consisting of: aliphatic diols, such as ethylene glycol, diethylene glycol, triethylene glycol, propylene glycol, butandiol, hexanediol, neopentyl glycol, or glycerine; alicyclic diols, such as cyclohexane diol, cyclohexanedimethanol, hydrogen-added bisphenol A; and aromatic diols, such as bisphenol A-ethylene oxide adduct or bisphenol A-propylene oxide adduct. At least one kind of these polyalcohols may be used. Also, in order to have a cross-link structure or a branch structure for ensuring a favorable fixing, a poly alcohol having 3 or more —OH groups, such as glycerin, trimethylolpropane, or pentaerythritol, may be used together with a diol.

The crystalline polyester resin may have a melting temperature Tm, for example, in a range from 60° C. to 100° C., and as another example, from 60° C. to 75° C. If the melting temperature Tm of the crystalline polyester resin lies between 60° C. to 100° C., the agglomeration of toner particles is inhibited, the preservability of a fixed image is increased, and low-temperature fixability is increased. The amorphous polyester resin may have a glass transition temperature Tg, for example, in a range from 50° C. to 80° C. and as another example, in a range from 50° C. to 70° C.

When the crystalline polyester resin is added to the amorphous polyester resin, a high fixability may be achieved near a melting temperature due to the sharp melting characteristics of the crystalline polyester resin, that is, viscosity is rapidly reduced by rapidly melting at a narrow temperature range. When a crystalline polyester resin having a relatively low melting point Tm (greater than the glass transition temperature Tg of the amorphous polyester resin) is added to the amorphous polyester resin within an amount range that the durability and heat storage ability of a toner is maintained, the toner having a high fixability at a low temperature may be obtained. That is, when the crystalline polyester resin and the amorphous polyester resin are mixed, a rapid reduction of the melting temperature Tm at a fixing temperature may be obtained by the sharp melting characteristics of the crystalline polyester resin while a high glass transition temperature Tg of the amorphous polyester resin is maintained, a high temperature storage ability is maintained, and a low-temperature fixability may be provided.

The releasing agent may increase low-temperature fixability, final image durability, and anti-abrasion characteristic of a toner. The releasing agent may be a natural wax or a synthesized wax. The kind of releasing agent is not limited thereto, and may be one selected from the group consisting of a polyethylene wax, a polypropylene wax, a silicon wax, a paraffin group wax, an ester wax, a carnauba wax, and a metallocene wax. The releasing agent may be an ester wax that includes an ester group. Specific examples of the ester wax include: (1) a mixture of an ester wax and a non-ester wax; or (2) an ester group containing wax in which an ester group is added to a non-ester wax. In this case, because the ester group has high affinity to a latex component of the toner, the wax may be uniformly distributed in a toner particle, and thus, the wax may effectively perform. Further, the non-ester wax component may repress an excessive plasticizing function by the releasing action with latex, unlike when the wax is only ester wax. As a result, the mixture of an ester wax and a non-ester wax allows the toner to maintain a favorable developing ability for a long time.

The ester-based wax may be, for example, an ester of an aliphatic acid having a carbon number of 15 to 30 with an 1 to 5-hydric alcohol, such as, behenic acid behenyl ester, stearic acid stearyl ester, stearic acid ester of pentaeritritol, or montanic acid glyceride. The alcohol component that constitutes the ester may be mono-hydric alcohols having a carbon number of 10 to 30, or poly-hydric alcohols having a carbon number of 3 to 10. The non-ester wax may include a polyethylene-based wax, a polypropylene-based wax, a silicon-based wax, and a paraffin-based wax. The examples of the ester wax that includes an ester group may be: a mixture of a paraffin wax and an ester wax; or a paraffin wax containing an ester group. Specific examples of these waxes may include P-212, P-280, P-318, P-319, and P-419, from of Chukyo Yushi Co., Ltd. When the releasing agent is a mixture of a paraffin wax and an ester wax, the content of the ester wax may be, for example, in a range from 1 to 35 weight %, from 5 to 30 weight %, or from 7 to 30 weight % with respect to the total weight of the paraffin wax and the ester wax. If the content of the ester wax is greater than 1%, the compatibility with respect to latex may be sufficiently maintained, and if the content of the ester wax is less than 35%, a long term developing capability may be provided due to appropriate plasticity of the toner. In the toner, when the value of a solubility parameter SP of a binder resin is compared to that of a solubility parameter SP of the paraffin wax and a solubility parameter SP of the ester wax, the releasing agent may be selected so that the value difference of the solubility parameters SPs is greater than 2. If the value difference of the solubility parameters SPs is small, a plasticization phenomenon may occur between the binder resin and the releasing agent.

The releasing agent may have a melting point, for example, in a range from 60° C. to 100° C., and as another example, in a range from 70° C. to 90° C. The component of the releasing agent may physically tightly contact the toner particles, but may not form a covalent bond with the toner particles.

The content of the releasing agent may be in a range from 1 to 20 parts by weight, in a range from 2 to 16 parts by weight, or in a range from 3 to 12 parts by weight based on 100 parts by weight of the toner. If the content of the releasing agent is greater than 1 part by weight, favorable low-temperature fixability may be provided and a sufficient fixing temperature range may be provided, and if the content of the releasing agent is less than 20 parts by weight, storage ability and economy may be improved.

The colorant may be, for example, a black colorant, a cyan colorant, a magenta colorant, or a yellow colorant.

The black colorant may be carbon black or aniline black.

The yellow colorant may be a condensed nitrogen compound, an isoindolinon compound, an anthraquinone compound, an azo metal complex dye, or an aryl imid compound. More specifically, the yellow colorant includes C.I. pigment yellow 12, 13, 14, 17, 62, 74, 83, 93, 94, 95, 109, 110, 111, 128, 129, 147, 168, and 180.

The magenta colorant may be condensed nitrogen compounds, anthraquine compounds, quinacridone compounds, base dye rate compounds, naphtol compounds, benzo imidazole compounds, thioindigo compounds, or perylene compounds. More specifically, the magenta colorant may include C.I. pigment red 2, 3, 5, 6, 7, 23, 48:2, 48:3, 48:4, 57:1, 81:1, 122, 144, 146, 166, 169, 177, 184, 185, 202, 206, 220, 221, or 254.

The cyan colorant may be copper phthalocyanine compounds and its derivatives or anthraquinone compounds. More specifically, the cyan colorant may include C.I. pigment blue 1, 7, 15, 15:1, 15:2, 15:3, 15:4, 60, 62, or 66.

These colorants may be used alone or in combination, and may be selected in consideration of color, chroma, brightness, weather resistance, and dispersing ability in a toner particle.

The content of the colorant may be a sufficient amount to dye a toner. For example, the content of the colorant may be in a range from 0.5 to 15 parts by weight, from 1 to 12 parts by weight, or from 2 to 10 parts by weight based on 100 parts by weight of the toner. If the content of the colorant is greater than 0.5 parts by weight based on 100 parts by weight of the toner, a coloring effect may be realized. If the content of the colorant is less than 15 parts by weight based on 100 parts by weight of a toner, the cost push for manufacturing a toner is not affected much and a sufficient amount of triboelectric charges may be provided.

The toner particle satisfies the following Equations (1) and (2).

$$-4.3 \leq \log(S_{stain}/S_{toner}) \leq -2.1, \quad (1)$$

$$5 \leq N_{stain} \leq 25, \quad (2)$$

Here, $S_{toner}$ is a surface area of the toner particles, $S_{stain}$ is a total area of stained regions formed on the surfaces of the toner particles when the toner particles are stained with $RuO_4$, and $N_{stain}$ is the number of the stained regions.

The constituent elements of the toner may be exposed on a surface of the toner particle. Thus, the surfaces of the toner particles may be divided into a crystalline polyester resin region, an amorphous polyester resin region, a releasing agent region, and a colorant region. Also, an area of each of the regions may be 0 (zero) or varied according to the degree of exposing the constituent elements of the toner on the surface of the toner.

$RuO_4$ stains the crystalline polyester resin region and the releasing agent region which are exposed on the surface of the toner. However, $RuO_4$ does not stain the amorphous polyester resin region and the colorant region which are exposed on the surface of the toner. Accordingly, $S_{stain}$ indicates the total area of the crystalline polyester resin regions and the releasing agent regions on the surfaces of the toner particles, and $N_{stain}$ indicates the sum of the number of the crystalline polyester resin regions and the releasing agent regions on the surfaces of the toner particles.

FIG. 1 is a scanning electron microscopy (SEM) image of toner particles stained with $RuO_4$. In FIG. 1, black spots in small circles are the stained regions with $RuO_1$. $N_{stain}$ is the number of regions stained with $RuO_4$. For example, the toner particle located in the center of FIG. 1 shows three stained regions. Therefore, the $N_{stain}$ of the toner particle located in the center is 3. Although the particles are round shapes, $S_{toner}$ and $S_{stain}$ are measured from plane images of a photo taken by using an SEM. That is, the $S_{toner}$ and $S_{stain}$ are measured from a plane image of a toner projected to a plane. $S_{toner}$ is the total area occupied by the toner particles on a plane image of the toner, and $S_{stain}$ is the total area occupied by the regions stained with $RuO_1$ on the plane image of the toner.

$\text{Log}(S_{stain}/S_{toner})$ and $N_{stain}$ represent morphological characteristics of the surface of a toner, toner. The morphological characteristics of the surface of a toner characterize the thermal property and the physical property of the toner particle. That is, when the toner particle does not satisfy the above Equations (1) and (2), gloss, charge stability, anti-cohesiveness, and storage stability are degraded. When the toner particle satisfies the above Equations (1) and (2), gloss, charge stability, anti-cohesiveness, and storage stability may be simultaneously improved.

If the toner particle does not satisfy the above Equations (1) and (2), the crystalline polyester resin region and the releasing agent region are too much exposed or too little exposed.

The ratio and values of electrical resistance of a crystalline polyester resin and a non-crystalline polyester resin may affect the charge stability of a toner. When the crystalline polyester resin and the amorphous polyester resin satisfy the following Equations (3) and (4), the charge amount of a charged toner may be prevented from being rapidly reduced, and therefore, high charge stability may be provided.

$$1 \le R_{crystalline}/R_{amorphous} \le 100, \quad (3)$$

$$15 \le \log [R_{crystalline}] \le 20, \quad (4)$$

Here, $R_{crystalline}$ is an electrical resistance [Ω] of the crystalline polyester resin and $R_{amorphous}$ is an electrical resistance [Ω] of the amorphous polyester resin.

The electrical resistances Ω of the crystalline polyester resin and the amorphous polyester resin are measured by the voltage current method according to ASTM D991.

However, when the crystalline polyester resin and the amorphous polyester resin do not simultaneously satisfy Equations (3) and (4), the charge stability may be severely degraded due to the rapid reduction of charges of the charged toner.

The compatibility between the three components, that is, the crystalline polyester resin, the amorphous polyester resin, and the releasing agent, directly affects the size of a dispersion domain of each of the components, the shape of a dispersion domain of each of the components, and the melt viscosity of each of the components, and accordingly, in a process of manufacturing a toner, the compatibility governs the morphological structure in a toner particle. Hydrophilic functional groups such as a carboxylic group, a hydroxyl group, and an ester bond included in a polyester molecular structure are important factors that realize low temperature fixability. However, due to the hydrophilic functional groups, the polyester shows tendency of absorbing moisture. If the compatibility between the three components, that is, the crystalline polyester resin, the non-crystalline polyester resin, and the releasing agent is inappropriate, then, in a process of manufacturing a toner, the crystalline polyester resin region grows in a needle shape, and the electric charge density of the toner may be reduced since the dielectric loss factor is increased by the moisture-absorbed polyester. Also, the reduction of releasibility may occur in an oil-less fixing system. Furthermore, when an end of the crystalline polyester resin region protrudes from an outer surface of a toner particle, the storage stability of the toner may be reduced due to the reduction of anti-cohesiveness. When the crystalline polyester resin, the amorphous polyester resin, and the releasing agent satisfy the following Equations (5), (6), and (7), the growing of the crystalline polyester resin region in a needle shape and the incidence of surface protrusion of the crystalline polyester resin region may be decreased.

$$\Delta SP_{\alpha} = |SP_{amorphous} - SP_{crystalline}| \ge 3, \quad (5)$$

$$\Delta SP_{\beta} = |SP_{crystalline} - SP_{wax}| \le 1, \quad (6)$$

$$\Delta SP_{\gamma} = |SP_{amorphous} - SP_{wax}| \ge 2.5, \quad (7)$$

Here, $SP_{amorphous}$ is the solubility parameter $[(J/cm^3)^{0.5}]$ of the amorphous polyester resin, $SP_{crystalline}$ is the solubility parameter $[(J/cm^3)^{0.5}]$ of the crystalline polyester resin, and $SP_{wax}$ is the solubility parameter $[(J/cm^3)^{0.5}]$ of the releasing agent.

The solubility parameter is the Hildebrand Solubility parameter and is calculated by Fedors' method, $SP = [(\Sigma E_{cohesive})/(\Sigma V)]\hat{}0.5$, where $E_{cohesive}$ is a cohesive energy density and V is a unit volume of molecules.

When the compatibility between the three components, that is, the crystalline polyester resin, the amorphous polyester resin, and the releasing agent satisfies the above three Equations (5), (6), and (7), the morphological characteristic expressed as Equations (1) and (2) may be achieved.

A toner for developing an electrostatic image, according to an exemplary embodiment of the present general inventive concept, may include a core layer that includes a crystalline polyester resin, an amorphous polyester resin, a releasing agent, and a colorant; and a shell layer that includes an amorphous polyester resin.

In a process of manufacturing a toner based on the emulsion and aggregation (EA) process, the constituent components of the core layer may be exposed on a surface of the toner particle, that is, a surface of the shell layer. Accordingly, the surface of the toner may be divided into a crystalline polyester resin region, an amorphous polyester resin region, and a releasing agent region. Also, an area of each of the regions may be 0 (zero) or varied according to the degree of exposure of the toner constituent components on the surface of the toner particle. Accordingly, the toner according to the current exemplary embodiment also belongs to the scope of a toner for developing an electrostatic image that includes a crystalline polyester resin, an amorphous polyester resin, a releasing agent, and a colorant.

Also, the morphological characteristic of the surface of the toner may control thermal characteristics and physical characteristics of the toner particles. That is, when the conditions of Equations (1) and (2) are satisfied, gloss, charge stability, anti-cohesiveness, storage stability, and low temperature fixability of the toner may be simultaneously satisfied. However, when the conditions of Equations (1) and (2) are not satisfied, the gloss, charge stability, anti-cohesiveness, and storage stability of the toner may be degraded.

Similarly, the conditions of Equations (5), (6), and (7) may apply to the three components, that is, the crystalline polyester resin in the core layer, the amorphous polyester resin in the core layer, and the releasing agent in the core layer. Also, the conditions of Equations (3) and (4) may apply to the crystalline polyester resin in the core layer and the amorphous polyester resin in the core layer.

Hereinafter, a method of manufacturing a toner for developing an electrostatic image based on the EA process is be described.

The method of manufacturing a toner for developing an electrostatic image may include: forming a core by mixing a first binder resin latex that includes a crystalline polyester resin and an amorphous polyester resin, a releasing agent, and a staining agent with a coagulant; forming particles that each include a core and a shell layer by forming a shell layer on at least a portion of a surface of the core by adding a second binder resin latex that includes the amorphous polyester resin to a dispersion solution of the core; agglomerating the particles; and unifying the coagulated particles.

The crystalline polyester resin of the first binder resin latex, the amorphous polyester resin of the first binder resin latex, and the releasing agent satisfy the following Equations (5), (6), and (7).

$$\Delta SP_{\alpha}=|SP_{amorphous}-SP_{crystalline}|\geq 3, \quad (5)$$

$$\Delta SP_{\beta}=|SP_{crystalline}-SP_{wax}|\leq 1, \quad (6)$$

$$\Delta SP_{\gamma}=|SP_{amorphous}-SP_{wax}|\geq 2.5, \quad (7)$$

Here, $SP_{amorphous}$ is the solubility parameter $[(J/cm^3)^{0.5}]$ of the amorphous polyester resin, $SP_{crystalline}$ is the solubility parameter $[(J/cm^3)^{0.5}]$ of the crystalline polyester resin, and $SP_{wax}$ is the solubility parameter $[(J/cm^3)^{0.5}]$ of the releasing agent.

The first binder resin latex may be obtained by mixing a crystalline polyester resin latex and an amorphous polyester resin latex that are individually formed. Also, the first binder resin latex may be obtained by converting a mixture that includes a crystalline polyester resin and an amorphous polyester resin to a latex type.

A crystalline polyester resin and an amorphous polyester resin may be manufactured as a latex type by using a phase inversion emulsification. For this purpose, a polyester organic solution is formed by dissolving the polyester resin in an organic solvent. The organic solvent may be a ketone solvent such as acetone or methyl ethyl ketone; an aliphatic alcohol solvent such as methanol, ethanol, or isopropanol; or a mixture of these materials. Next, NaOH, KOH, or ammonium hydroxide is added to the organic solution and the solution is stirred. At this point, an amount of a basic compound to be added is determined by the equivalent ratio of the basic compound with respect to the content of a carboxylic group, the equivalent ratio being obtained from an acid value of the polyester resin. Next, a phase inversion emulsification that transforms the organic solution to an oil-in-water emulsion is performed by adding an excess amount of water to the polyester resin organic solution. At this point, optionally, a surfactant may further be added. A polyester resin latex may be obtained by removing the organic solvent from the obtained emulsion by using a method, such as a vacuum distillation method. As a result, a resin latex (emulsion) that includes polyester resin particles having an average particle size of, for example, below 1 μm, specifically, in a range from 100 nm to 300 nm, and more specifically, in a range from 150 nm to 250 nm is obtained.

The content of the resin latex solid is not specifically limited, but may be in a range from 5 weight % to 40 weight %, for example, in a range from 15 weight % to 30 weight %. The first binder resin latex that performs as a binder resin in the core layer is prepared by mixing the amorphous polyester resin latex and the crystalline polyester resin latex prepared as described above. Instead of mixing the amorphous polyester resin latex and the crystalline polyester resin latex in advance, the amorphous polyester resin latex and the crystalline polyester resin latex may individually be mixed as a part of the first binder resin latex when a staining agent dispersion solution and a releasing agent dispersion solution are mixed.

If necessary, the above polyester latex may include another polymer obtained by polymerizing at least one kind of polymerizable monomer. In this case, the polymerizable monomer may be at least one selected from the group consisting of a styrene group monomer, such as styrene, vinyl toluene, and α-methylstyrene; an m-acrylic acid derivative, such as acrylic acid, methacrylate, methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, and methacrylamide; an ethylene type unsaturated mono olefin, such as ethylene, propylene, and butylenes; a halogenated vinyl, such as vinyl chloride, vinylidene chloride, and vinyl fluoride; a vinyl ester, such as vinyl acetate and vinyl propionate; a vinyl ether, such as vinyl methyl ether and vinyl ethyl ether; a vinyl ketone, such as vinyl methyl ketone and methyl isopropenyl ketone; and a nitrogen-containing vinyl compound, such as 2-vinylpyrridine, 4-vinylpyrridine, and N-vinylpyrrolidone.

The above polyester latex may further include a charge control agent. The charge control agent may include a negative charge control agent and a positive charge control agent. The negative charge control agent may be an organic metal complex or a chelate compound, such as a Cr containing azo dye or a monoazo metal complex; salicylic acid containing a metal, such as Cr, Fe, or Zn; an organic metal complex of aromatic hydroxycarboxylic acid and aromatic dicarboxylic acid, but is not limited thereto. The positive charge control agent may include a reformed product of nigrosine and its aliphatic metal salt; an onium salt that includes a quaternary ammonium salt, such as tributylbenzylammonium 1-hydroxy-4-naphthosulfonate and tetrabutylammonium tetrafluoroborate. The charge control agent stably supports a toner on a developing roller by an electrostatic force, and thus, the use of the charge control agent enables the toner to be charged at a stable and rapid charge speed.

Next, a mixed solution is obtained by mixing the first binder resin latex with a colorant dispersion solution and a releasing agent dispersion solution.

The colorant dispersion solution may be obtained by uniformly dispersing a colorant, such as black, cyan, yellow, or magenta, with a composition that includes an emulsifying agent by using an ultrasonic homogenizer or a microfluidizer. The kinds and content of the colorants to be used are the same as described above. The colorant may be used as one or a mixture of at least two colorants, and may be selected in consideration of color, chroma, brightness, durability, and the dispersibility in a toner. The emulsifying agent that is used for manufacturing a colorant dispersion solution may be an anionic reactive emulsifying agent, a nonionic reactive emulsifying agent, or a mixture of these emulsifying agents. Specific examples of the anionic reactive emulsifying agent include HS-10 from Dai-ichi Kogyo Co. and Dowfax 2A1 from Rhodia Co. The specific example of the nonionic reactive emulsifying agent includes RN-10 from Daiichi Kogyo Co.

The releasing agent dispersion solution includes a releasing agent, water, and an emulsifying agent. The types and content of the releasing agent are the same as described above. An emulsifying agent included in the releasing agent dispersion solution may be one well known in the art as the emulsifying agent to be used in the colorant dispersion solution.

A mixture solution is obtained by mixing the first binder resin latex, the colorant dispersion solution, and the releasing agent dispersion solution obtained as described above. For manufacturing the mixture solution, a homomixer or a homogenizer may be used.

Next, core particles that include the first binder resin latex, the colorant, and the releasing agent are formed by adding a coagulant to the mixture solution. More specifically, after controlling the pH of the mixture solution to 0.1 to 4.0 and adding a coagulant to the mixture solution at a temperature below the melting point of the crystalline polyester and below the Tg of the amorphous polyester, for example, at a temperature in a range from 25° C. to 70° C., and more specifically, in a range from 35° C. to 60° C., core particles (or a primarily coagulated toner) are formed by a shear-induced aggregation mechanism using a homogenizer.

The coagulant may be a Si and Fe-containing metal salt. When the Si and Fe-containing metal salt is used, the size of the primarily coagulated toner increases due to the collision between particles and the increased ionic strength of the primarily coagulated toner. The Si and Fe-containing metal salt may include, for example, polysilicato iron, and more specifically, PSI-025, PSI-050, PSI-085, PSI-100, PSI-200, and PSI-300 from Suido Kiko Co. The physical properties and compositions are summarized in Table 1. The Si and Fe-containing metal salt shows a strong coagulating force even though in an amount smaller and at a temperature lower than the coagulant used in the EA method, and also, because iron and silica are the main components, the problem of an adverse effect of residual aluminum to the human body, which is a problem of the conventional three ionic value aluminum polymer coagulant, may be decreased.

The content of the coagulant may be, for example, in a range from 0.1 parts by weight to 10 parts by weight, in a range from 0.5 parts by weight to 8 parts by weight, or in a range from 1 part by weight to 6 parts by weight based on 100 parts by weight of the first binder resin latex. At this point, if the content of the coagulant is greater than 0.1 parts by weight, coagulation efficiency may be increased, and if the content of the coagulant is below 10 parts by weight, the chargeability of the toner may be decreased, and thus, particle distribution of the toner may be improved.

Next, a shell layer is formed on surfaces of the core particles by attaching a second binder resin latex on the surfaces of the core particles after adding the second binder resin latex that includes an amorphous polyester resin latex to the core particle distribution solution. The second binder resin may include a low molecular weight amorphous polyester resin having a weight-average molecular weight in a range from 6,000 to 20,000 g/mol and a high molecular weight amorphous polyester resin having a weight-average molecular weight in a range from 25,000 to 100,000 g/mol.

Next, after controlling the pH in the system in a range from 6 to 9, when the particle size is maintained at a constant level for a period of time, toner particles having a particle size in a range from 3 μm to 9 μm, or in a range from 5 μm to 7 μm are manufactured through a fusing process at a temperature in a range from 85° C. to 100° C. (at a temperature approximately 20° C. to 25° C. higher than the glass transition temperature Tg of the amorphous polyester).

After the fusing process, another coagulating and fusing process may further be performed after reducing the system temperature to below the glass transition temperature Tg of the amorphous polyester. Also, a third latex may be additionally coated on the toner (or a secondarily coagulated toner) formed of a core-shell layer. The third latex may be a polyester resin or a mixture of a polyester resin and a polymer manufactured by polymerizing at least one polymerizable monomer.

In this way, the forming of the additional shell layer increases durability of the toner and may reduce a storage problem of the toner when the toner is shipped or handled. The toner particles are classified and dried by filtering the obtained secondarily coagulated toner or the third coagulated toner. When an external additive is added to the dried toner, a charge amount is controlled, and thus, a final dried toner is obtained. The external additive may include silica, titania, and alumina. The amount of the external additive may be, for example, in a range from 1.5 parts by weight to 7 parts by weight, or in a range from 2 parts by weight to 5 parts by weight of 100 parts by weight of non-added toner. When the amount of the external additive is greater than 1.5 parts by weight, a caking phenomenon in which particles are agglomerated to each other by the coagulating force of the

TABLE 1

| Types | | PSI-025 | PSI-050 | PSI-085 | PSI-100 | PSI-200 | PSI-300 |
|---|---|---|---|---|---|---|---|
| Mole ratio of Si/Fe | | 0.25 | 0.5 | 0.85 | 1 | 2 | 3 |
| Main components concentration | Fe (wt %) | 5.0 | 3.5 | 2.5 | 2.0 | 1.0 | 0.7 |
| | SiO2 (wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| viscosity (mPa · S) | | More than 2.0 | | | | | |
| Average molecular weight (g/mol) | | 500,000 | | | | | |
| appearance | | Yellowish brown transparent liquid | | | | | |

toner particles may be decreased, and thus, the charge amount is stable. If the amount of the external additive is below 7 parts by weight, roller contamination caused by an excessive amount of the external additive may be decreased.

When the crystalline polyester resin, the amorphous polyester resin, and the releasing agent used in the first binder resin latex satisfy the following Equations (5), (6), and (7), the growth of a needle shape in the crystalline polyester resin region and the surface protrusion in the crystalline polyester resin region may be decreased, and the morphological characteristics expressed as Equations (1) and (2) may be readily achieved.

$$\Delta SP_{\alpha}=|SP_{amorphous}-SP_{crystalline}|\geq 3, \quad (5)$$

$$\Delta SP_{\beta}=|SP_{crystalline}-SP_{wax}|\leq 1, \quad (6)$$

$$\Delta SP_{\gamma}=|SP_{amorphous}-SP_{wax}|\geq 2.5, \quad (7)$$

Here, $SP_{amorphous}$ is the solubility parameter $[(J/cm^3)^{0.5}]$ of the amorphous polyester resin, $SP_{crystalline}$ is the solubility parameter $[(J/cm^3)^{0.5}]$ of the crystalline polyester resin, and $SP_{wax}$ is the solubility parameter $[(J/cm^3)^{0.5}]$ of the releasing agent.

When the crystalline polyester resin and the amorphous polyester resin used in the first binder resin latex satisfy the following Equations (3) and (4), the rapid reduction of charged toner charge may be decreased, and thus, a high charge stability may be provided.

$$1\leq R_{crystalline}/R_{amorphous}\leq 100, \quad (3)$$

$$15\leq \log [R_{crystalline}]\leq 20, \quad (4)$$

Here, $R_{crystalline}$ is an electrical resistance Ω of the crystalline polyester resin, and $R_{amorphous}$ is an electrical resistance Ω of the amorphous polyester resin.

Hereinafter, exemplary embodiments according to the present general inventive concept are described further in detail, but the present general inventive concept is not limited thereto.

EXAMPLES

Tables 2 and 3 summarize weight-average molecular weights Mws, glass transition temperatures Tgs, melting points Tms, solubility parameters, and electrical resistances of amorphous polyester resins (A-1 through A-4) and crystalline polyester resins (C-1 through C-4).

TABLE 2

| Amorphous polyester resin | Mw [g/mol] | Tg [° C.] | Solubility parameter $[(J/cm^3)^{0.5}]$ | Electrical resistance $[R]/10^{15}$ [Ω] |
|---|---|---|---|---|
| A-1 | 18,300 | 64 | 22.44 | 19 |
| A-2 | 11,100 | 61 | 22.69 | 42 |
| A-3 | 79,100 | 68 | 20.17 | 1 |
| A-4 | 44,800 | 60 | 22.32 | 3.1 |

TABLE 3

| Crystalline polyester resin | Mw [g/mol] | Tm [° C.] | Solubility parameter $[(J/cm^3)^{0.5}]$ | Electrical resistance $[R]/10^{15}$ [Ω] |
|---|---|---|---|---|
| C-1 | 13,200 | 63 | 18.38 | 230 |
| C-2 | 18,100 | 66 | 21.07 | 6.2 |
| C-3 | 12,700 | 65 | 19.21 | 0.93 |
| C-4 | 11,800 | 65 | 18.97 | 163 |

The glass transition temperature Tg and the melting point of the amorphous polyester resin and the crystalline polyester resin were measured by a DSC method according to ASTM D-3418-8 on a Perkin Elmer DSC6 with the following heating profile: heating to 150° C. from room temperature at a heating rate of 10° C./min, maintained at 150° C. for 1 min.; cooling to 0° C. from 150° C. at a cooling rate of 10° C./min, maintained at 150° C. for 1 min.; and heated to 150° C. from 0° C. at a heating rate of 10° C./min.

The solubility parameter is the Hildebrand Solubility Parameter and was calculated by using Fedor's method [$SP=[(\Sigma E_{cohesive})/(\Sigma V)]\hat{}0.5$, here, $E_{cohesive}$ is cohesive energy density, and V is unit volume of molecules].

The electrical resistances of the amorphous polyester resin and the crystalline polyester resin were measured by using a Digital Ohm Meter R-506 from Kawaguchi Electric Works Co., Ltd according to ASTM D991 Voltage-Current method at 25° C. and 1 atm. The resistances were obtained by measuring a voltage between inner electrodes by applying a current to an external electrode for one minute.

The weight-average molecular weights Mws are the results of measuring a tetrahydrofuran (THF) soluble component of the polyester resin by using a gel permeation chromatography (GPC) method.

The A-2 and A-3 were used as the low molecular weight amorphous polyester resin (LA-1) and the high molecular weight amorphous polyester resin (HA-1), respectively, used as binders for a shell layer.

Manufacture Example 1

Amorphous Polyester Latex A-1

After placing 400 g of amorphous polyester resin A-1, 600 g of methyl ethyl ketone (MEK), and 100 g of isopropyl alcohol (IPA) in a 3-liter reactor, the A-1 resin was dissolved by stirring using a semi-moon type impeller at 30° C. 30 g of aqueous ammonia 5 wt % solution was slowly added to the obtained A-1 resin solution while stirring the A-1 resin solution, and then, 1,500 g of water was added at a rate of 20 g/min while stirring the A-1 resin solution, and thus, an emulsion was obtained. A solvent was removed from the manufactured emulsion by a vacuum distillation method, and thus, a latex A-1 having a solid content of 20 wt % was obtained.

Manufacture Examples 2 to 4

Amorphous Polyester Latexes A-2 to A-4

Amorphous polyester latexes A-2 through A-4 were manufactured in the same method used to manufacture the latex A-1 except for using one of the amorphous polyester resins A-2 through A-4 instead of the amorphous polyester resin A-1, and except for the amount of aqueous ammonia 5 wt % solution was slightly changed so that pH of the solution was adjusted to pH 7 to 8.

Manufacture Example 5

Crystalline Polyester Latex C-1

After placing 600 g of crystalline polyester resin C-1, 300 g of MEK, and 100 g of IPA in a 3-liter reactor, the crystalline polyester resin C-1 was dissolved by stirring using a semi-moon type impeller at 30° C. 30 g of aqueous ammonia 5 wt % solution was slowly added to the obtained crystalline polyester resin solution while stirring the crystalline polyester resin solution, and then, 2,500 g of water was added at a rate of 20 g/min while stirring the crystalline polyester resin solution, and thus, an emulsion was obtained. A solvent was removed from the manufactured emulsion by using a vacuum distillation method, and thus, a latex C-1 having a solid content of 15 wt°/0 was obtained.

Manufacture Examples 6 Through 8

Crystalline Polyester Latexes C-2 Through C-4

Crystalline polyester latexes C-2 through C-4 were manufactured as the same method as in the manufacture example 5 except for using one of the crystalline polyester resins C-2 through C-4 instead of the crystalline polyester resin C-1, and except for the amount of aqueous ammonia 5 wt %-solution was slightly changed so that the pH of the solution was adjusted to a pH of 7 to 8.

Manufacture Example 9

Colorant Dispersion Solution

Total 10 g of an anionic reactive emulsifying agent (HS-10; from DAI-ICHI KOGYO Co.) and a nonionic reactive emulsifying agent (RN-10; from DAI-ICHI KOGYO Co.) with a ratio specified in Table 4 and 60 g of a cyan pigment (PB 15:4) were placed in a milling bath and were milled at room temperature after inputting 400 g of glass beads having a diameter of 0.8-1 mm, and thus, a colorant dispersion solution was manufactured.

TABLE 4

| Color | Pigment | HS-10:RN-10 (mixing weight ratio) |
|---|---|---|
| cyan | PB 15:4 | 100:0 |
| | | 80:20 |
| | | 70:30 |

<Releasing Agent Dispersion Solution>

As the releasing agent, a wax dispersion solution SELOSOL P-212 (paraffin wax 80-90 wt %, synthetic ester wax 10-20 wt %; Tm is 72° C.; Viscosity is 13 mPa·s at 25° C.; and from CHUKYO YUSHI CO. LTD) was used. The solubility parameter of the wax was 18.48 $(J/cm^3)^{0.5}$.

Manufacture Example 10

Binder Resin Latex for Shell Layer

A low molecular weight amorphous polyester latex (LA-1) and a high molecular weight amorphous polyester latex (HA-1) were manufactured in the same method used to manufacture the latex A-1 except for using the low molecular weight amorphous polyester (LA-1) and the high molecular weight amorphous polyester (HA-1) instead of using the amorphous polyester A-1, and except for the amount of aqueous ammonia 5 wt % solution was slightly changed so that pH of the solution was adjusted to pH 7 to 8. Next, a shell layer binder resin latex was obtained by mixing the LA-1 latex and the HA-1 latex in a weight ratio of 1:1.

Example 1

Manufacture of Toner 764 g of deionized water, 700 g of A-1 latex, 112 g of C-1 latex were stirred in a 3-liter reactor at 350 rpm. After inputting 77 g of cyan pigment dispersion solution (HS-10 100%) of manufacture example 9 and 80 g of the wax dispersion solution (SELOSOL P-212), 50 g (0.3 mol) of nitric acid having a concentration of 0.3N and 25 g of PSI-100 (from Suido Kiko Co.) as a coagulant were further added to the solution, and then, the solution was heated to 50° C. at a heating rate of 1° C./min while stirring the solution using a homogenizer. Next, the coagulation reaction was continued while increasing the temperature of the coagulating solution at an increasing rate of 0.03° C./min, and thus, a primarily coagulated toner having a volume average diameter of 4 to 5 μm was formed.

Next, after adding 300 g of a binder resin latex for a shell layer to the reactor and coagulating for 0.5 hours, the pH of the system was controlled to 8 by adding 1N NaOH aqueous solution. After 20 minutes, the temperature of the system was increased to 85° C., each of the coagulate particles was unified for 4 hours, and thus, secondarily coagulated toner particles having a mean volume diameter of 5 to 7 μm were obtained. After cooling the coagulating mixture below 28° C., the toner particles were separated through a filtering process and dried.

100 g of dried toner particles, 0.5 g of NX-90 (from Nippon Aerosil), 1.0 g of RX-200 (from Nippon Aerosil), and 0.5 g of SW-100 (from Titan Kogyo) were added into a mixer (KM-LS2K, from Daewha Tech.). Next, the mixture was stirred for 4 minutes at 6,000 rpm to add the external additives to the toner particles. As a result, a final toner having a mean volume diameter of 5 to 7 μm was obtained.

Examples 2 Through 4 and Comparative Examples 1 Through 6

Manufacture of Toner

Toners according to Examples 2 through 4 and Comparative examples 1 through 6 were manufactured in the same method used in Example 1 except for using the amorphous polyester resin latex and the crystalline polyester resin latex shown in Table 5 as an amorphous polyester latex for the core and a crystalline polyester latex for the core.

TABLE 5

| Item | Amorphous polyester latex | Crystalline polyester latex | $R_{crystalline}/R_{amorphous}$ | $\Delta SP_\alpha$ | $\Delta SP_\beta$ | $\Delta SP_\gamma$ |
|---|---|---|---|---|---|---|
| Example 1 | A-1 | C-1 | 12.1 | 4.06 | 0.1 | 3.96 |
| Example 2 | A-1 | C-4 | 8.57 | 3.47 | 0.49 | 3.96 |
| Example 3 | A-4 | C-1 | 74.2 | 3.11 | 0.1 | 3.84 |
| Example 4 | A-2 | C-4 | 3.88 | 3.72 | 0.49 | 4.21 |
| Comparative example 1 | A-2 | C-2 | 6.77 | 1.62 | 2.59 | 4.21 |

TABLE 5-continued

| Item | Amorphous polyester latex | Crystalline polyester latex | $R_{crystalline}/R_{amorphous}$ | $\Delta SP_\alpha$ | $\Delta SP_\beta$ | $\Delta SP_\gamma$ |
|---|---|---|---|---|---|---|
| Comparative example 2 | A-3 | C-1 | 0.004 | 1.79 | 0.1 | 1.69 |
| Comparative example3 | A-3 | C-2 | 0.16 | 0.9 | 2.59 | 1.69 |
| Comparative example 4 | A-4 | C-2 | 0.5 | 1.25 | 2.59 | 3.84 |
| Comparative example 5 | A-3 | C-3 | 1.07 | 0.96 | 0.73 | 1.69 |
| Comparative example 6 | A-2 | C-2 | 6.77 | 1.62 | 2.59 | 4.21 |

Table 5 summarizes the electrical resistance ratio ($R_{crystalline}/R_{amorphous}$) of the crystalline polyester resin for core and the amorphous polyester resin for core; the difference of solubility parameter ($\Delta SP_\alpha$) between the crystalline polyester resin for core and the amorphous polyester resin for core; the difference of solubility parameter ($\Delta SP_\beta$) between the crystalline polyester resin for core and the releasing agent; and the difference of solubility parameter ($\Delta SP_\gamma$) between the amorphous polyester resin for core and the releasing agent. As shown in Table 5, the toners according to Examples 1 through 4 were manufactured to satisfy Equations (5), (6), and (7).

<Evaluation Method of Toner>

Fixing Characteristic Evaluation

A test image was fixed under the following conditions by using a belt-type fuser of a model 660 color laser printer from Samsung Electronics Co. Ltd.)

Unfixed test image for test: 100% solid pattern

Test temperature: 100-180° C. (10° C. intervals)

Test paper: 60 g paper (Boise Co. X-9)

Fixing speed: 160 mm/sec

Dwell time: 0.08 sec

After measuring an optical density of a fixed image, a 3M 810 tape was attached over the image and a 500 g pendulum was reciprocally moved 5 times on the tape, and afterwards, the tape was removed. After removing the tape, an optical density was measured. The fixability was calculated by the following equation.

$$\text{Fixability}(\%)=(\text{optical density after peeling tape}/\text{optical density before peeling tape})\times 100$$

A fixing temperature region in which the fixability value is greater than 90% is regarded as a fixing region of the toner. A minimum temperature at which the fixability value is greater than 90% without a cold-offset is determined as a minimum fusing temperature (MFT). A minimum temperature at which a hot-offset occurs is determined as a hot offset temperature (HOT).

Gloss Evaluation

The gloss (%) was measured by using a Glossmeter (micro-TRI-gloss; from BYK Gardner) which is a gloss measuring instrument, under the following conditions: Temperature of the fixer: 160° C.; measuring angle: 60° C.; and measuring pattern: 100% solid pattern.

High Temperature Storage Evaluation 100 g of the externally added toner was placed in a developing unit of a model 660 color laser printer from Samsung Electronics). The developing unit in a packed state was kept in an oven under the following condition: 23° C., 55% relative humidity (RH) for 2 hours; then 40° C., 90% RH for 48 hours; then 50° C., 80% RH for 48 hours; then 40° C., 90% RH for 48 hours; then 23° C., 55% RH for 6 hours.

After keeping the toner as described above, the toner in the developer was visually inspected to determine whether there is formed a cake or not, and, after printing out a 100% solid pattern, image defects were evaluated.

o: good image, no caking

Δ: poor image, no caking

X: caking

Carr's Cohesion of Toner

Equipment: Hosokawa micron powder tester PT-S

Amount of specimen: 2 g (Externally added toner or external additive-free toner)

Amplitude: 1 mm, dial 3-3.5

Sieves: 53, 45, 38 μm

Vibration time: 120 sec

After keeping the powder at 23° C. and RH 55% for 2 hours, changes of amount before and after sieving the powder using the sieves were measured, and afterwards, Carr's Cohesion was calculated as follows.

$$[(\text{Mass of powder remaining on the largest sieve})/2\ \text{g}]\times 100 \quad (1)$$

$$[(\text{Mass of powder remaining on the medium size sieve})/2\ \text{g}]\times 100\times(3/5) \quad (2)$$

$$[(\text{Mass of powder remaining on the smallest sieve})/2\ \text{g}]\times 100\times(1/5) \quad (3)$$

$$\text{Carr's Cohesion}=(1)+(2)+(3)$$

The anti-cohesiveness of the toner was evaluated from the values of Carr's Cohesion.

◎: Carr's Cohesion≤10, very good anti-cohesiveness

○: 10<Carr's Cohesion≤20, favorable anti-cohesiveness

Δ: 20<Carr's Cohesion≤40, slightly poor anti-cohesiveness

X: 40<Carr's Cohesion, poor anti-cohesiveness

Evaluation of Charge Characteristic of Toner

After mixing 28.5 g of a carrier and 1.5 g of a toner in a 60 ml glass container using a tubular mixer, a charge amount of the toner was measured by using an electric field separation method. The charge stability of the toner at room temperature according to the stirring time and a ratio between the charge amount at high temperature and high humidity and the charge amount at low temperature and low humidity were used as the basis of the evaluation.

Room temperature and humidity: 23° C., RH 55%

High temperature and high humidity: 32° C., RH 80%

Low temperature and low humidity: 10° C., RH 10%

The evaluation basis of the charge stability under room temperature and humidity are as follows.

o: The charge saturation curve according to the stirring time is smooth and the range of fluctuation is small after charge saturation.

Δ: The charge saturation curve according to the stirring time is slightly fluctuated and the range of fluctuation is slightly observed (max. 30%) after charge saturation.

x: The charge saturation curve according to the stirring time is not saturated or the range of fluctuation is significantly large (greater than 30%) after charge saturation.

The evaluation basis of the charge stability according to environment change by using the charge ratio of the high temperature and high humidity charge amount/the low temperature and low humidity charge amount (HH/LL ratio) is as follows.

o: 0.55≤HH/LL ratio

Δ: 0.45≤HH/LL ratio<0.55 x: HH/LL ratio<0.45

Morphological Analysis of Surface of Toner Particle

After the toner particles were stained with $RuO_4$, a plane image of surfaces of the toner was obtained by using a field emission scanning electron microscope (FE-SEM) (from Hitachi, product name: S-4500; measuring condition: vacuum pressure greater than $10^{-4}$ Pa, accelerating voltage of 5~15 kV). From the plane image of the surfaces of the toner particles, the number of stained regions with $RuO_4$ ($N_{stain}$), a total area occupied by the toner particles ($S_{toner}$), and a total area occupied by the stained regions with $RuO_4$ ($S_{stain}$) were measured. The $S_{toner}$ and $S_{stain}$ were measured by using image analysis software (Image J 1.41) with respect to 50 toner particles shown in the SEM image.

Table 6 summarizes the evaluation results for the toners according to Examples 1 through 4 and Comparative examples 1 through 6.

TABLE 6

| Items | log ($S_{stain}$/ $S_{toner}$) | $N_{stain}$ | Gloss | Fixing characteristic MFT (° C.) | Fixing characteristic HOT (° C.) | Charge characteristic Stability | Charge characteristic HH/LL | Storage Stability | anti-cohesiveness |
|---|---|---|---|---|---|---|---|---|---|
| Example 1 | −2.6 | 9 | 12.8 | 118 | 200 | ○ | ○ | ○ | ◎ |
| Example 2 | −3.7 | 17 | 11.5 | 113 | 195 | ○ | ○ | ○ | ◎ |
| Example 3 | −4.2 | 24 | 10.1 | 119 | 190 | ○ | ○ | ○ | ◎ |
| Example 4 | −2.2 | 6 | 12.9 | 114 | 200 | ○ | ○ | ○ | ◎ |
| Comparative example 1 | −6.1 | 37 | 8.3 | 121 | 185 | ○ | Δ | ○ | ◎ |
| Comparative example 2 | −1.5 | 6 | 10.4 | 120 | 200 | Δ | Δ | Δ | ○ |
| Comparative example 3 | −0.3 | 3 | 10.9 | 122 | 200 | X | Δ | X | X |
| Comparative example 4 | −7.4 | 43 | 7.9 | 122 | 180 | ○ | Δ | ○ | Δ |
| Comparative example 5 | −1.0 | 5 | 10.4 | 121 | 200 | X | X | Δ | Δ |
| Comparative example 6 | −4.7 | 28 | 9.3 | 117 | 190 | Δ | Δ | X | Δ |

As shown in Table 5, the toners according to Examples 1 through 4, which were manufactured to satisfy Equations (5), (6), and (7) which are related to compatibility, and, as shown in Table 6, the toners according to Examples 1 through 4 satisfy the above Equations (1) and (2), which are related to the morphological characteristics of the surfaces of the toner. Furthermore, the toners according to Examples 1 through 4 that satisfy the above Equations (1) and (2) all simultaneously satisfy gloss, charge stability, anti-cohesiveness, storage ability, and low temperature fixability.

However, as shown in Table 5, the toners according to the Comparative Examples 1 through 6 which were manufactured to not satisfy Equations (5), (6), and (7) which are related to compatibility, as shown in Table 6, do not satisfy the above Equations (1) and (2) which are related to the morphological characteristics of the surfaces of the toner. Furthermore, the toners according to the Comparative Examples 1 through 6 that do not satisfy the above Equations (1) and (2) all fail to satisfy gloss, charge stability, anti-cohesiveness, storage ability, and low temperature fixability.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner for developing an electrostatic image, the toner comprising:

toner particles including:

a crystalline polyester resin having a melting temperature in a range of from 60° C. to 75° C.;

an amorphous polyester resin;

a releasing agent comprising a mixture of an ester wax and a non-ester wax with a content weight percentage of the ester wax being within a range of 1% to 35% of a total weight of the non-ester wax and the ester wax; and a colorant, wherein:

the toner particles have a mean volume diameter of 5 to 7 μm, when 50 of the toner particle are viewed in a plane image obtained by scanning electron microscopy (SEM), the 50 toner particles collectively project a plurality of surface regions onto the plane image, each of the plurality of surface regions being a region, of the crystalline polyester resin or the releasing agent, that is stainable by $RuO_4$ and exposed on the surface of one of the 50 toner particles, the plurality of surface regions including at least one region of the crystalline polyester resin, a total number of the plurality of surface regions projected onto the plane image is in a range of from 6 to 24, and an area $S_{stain}$ on the plane image occupied by a total surface area of the plurality of surface regions that is stainable by $RuO_4$, and a total area $S_{toner}$ on the plane image occupied by the toner particle satisfy $-4.3 \leq \log(S_{stain}/S_{toner}) \leq -2.1$, the toner particles have charge stability based on the crystalline polyester resin having an electrical resistance [Ω] and the amorphous polyester resin having an electrical resistance [Ω], the electrical resistance [Ω] of the crystalline polyester and the electrical resistance [Ω] of the amorphous polyester resin satisfy:

$$3.88 \leq R_{crystalline}/R_{amorphous} \leq 74.2,$$

$$15 \leq \log [R_{crystalline}] \leq 20,$$

where $R_{crystalline}$ is the electrical resistance [Ω] of the crystalline polyester resin and $R_{amorphous}$ is the electrical resistance [Ω] of the amorphous polyester resin, and compatibility between the amorphous polyester resin and the releasing agent as represented by a solubility parameter of the crystalline polyester resin, a solubility parameter of the amorphous polyester resin, and a solubility parameter of the releasing agent satisfy:

$$\Delta SP_{\alpha}=|SP_{amorphous}-SP_{crystalline}|\geq 3.11,$$

$$\Delta SP_{\beta}=|SP_{crystalline}-SP_{wax}|\leq 0.49,$$

$$\Delta SP_{\gamma}=|SP_{amorphous}-SP_{wax}|\geq 3.84,$$

where $SP_{amorphous}$ is the solubility parameter $[(J/cm^3)^{0.5}]$ of the amorphous polyester resin, $SP_{crystalline}$ is the solubility parameter $[(J/cm^3)^{0.5}]$ of the crystalline polyester resin, and $SP_{wax}$ is the solubility parameter $[(J/cm^3)^{0.5}]$ of the releasing agent.

* * * * *